US010896583B2

(12) United States Patent
Fishon et al.

(10) Patent No.: US 10,896,583 B2
(45) Date of Patent: Jan. 19, 2021

(54) NONCONVENTIONAL PLAYING CARDS, PLAYING CARD DECKS AND GAMES USING NONCONVENTIONAL CARDS

(71) Applicant: In Bet Gaming Inc., Freehold, NJ (US)

(72) Inventors: Todd Fishon, Henderson, NV (US); Ronald LaDuca, Cherry Hill, NJ (US)

(73) Assignee: AGS LLC, Las Vegas, NV (US)

( * ) Notice: Subject to any disclaimer, the term of this patent is extended or adjusted under 35 U.S.C. 154(b) by 148 days.

(21) Appl. No.: 16/192,318

(22) Filed: Nov. 15, 2018

(65) Prior Publication Data

US 2019/0266850 A1 Aug. 29, 2019

Related U.S. Application Data

(60) Provisional application No. 62/635,081, filed on Feb. 26, 2018.

(51) Int. Cl.
*G07F 17/32* (2006.01)

(52) U.S. Cl.
CPC ..... *G07F 17/3293* (2013.01); *G07F 17/322* (2013.01); *G07F 17/326* (2013.01); *G07F 17/3211* (2013.01)

(58) Field of Classification Search
CPC ..... G07F 17/32
See application file for complete search history.

(56) References Cited

U.S. PATENT DOCUMENTS 9,773,379 B2 * 9/2017 Hutchinson-Kay ..... G07F 17/326
2002/0101037 A1 * 8/2002 Addabbo ..... A63F 1/02 273/303
2004/0072604 A1 * 4/2004 Toyoda ..... G07F 17/32 463/16
2014/0265129 A1 * 9/2014 MacDonald ..... A63F 1/02 273/303
2015/0187172 A1 * 7/2015 Landen ..... G07F 17/323 463/11

* cited by examiner

*Primary Examiner* — Reginald A Renwick
(74) *Attorney, Agent, or Firm* — Weide & Miller, Ltd.

(57) ABSTRACT

Nonconventional playing cards, nonconventional decks of playing cards and method of playing and presenting games using such cards are provided. A nonconventional deck of playing cards may comprise a plurality of playing cards each having a card face bearing at least a primary indicium and a secondary indicium, the primary indicium comprising a card rank, at least a first number of the plurality of playing cards having a first card rank and a second number of the plurality of playing cards having a second card rank, the first and second numbers of cards being different. The primary indicia may comprise characters and the secondary indicia may comprise card background colors. A deck may comprise cards of 6 ranks and cards of each rank varying between 6 and 12 cards.

14 Claims, 7 Drawing Sheets

220W

220D

220D

220X

220T

220P

220M

220R

NONCONVENTIONAL PLAYING CARDS, PLAYING CARD DECKS AND GAMES USING NONCONVENTIONAL CARDS

RELATED APPLICATION DATA

This application claims priority to and incorporates by reference in its entirety herein U.S. Provisional Application Ser. No. 62/635,081, filed Feb. 26, 2018.

FIELD OF THE INVENTION

The present invention relates to gaming equipment and methods of presenting and playing games.

BACKGROUND OF THE INVENTION

Game developers and gaming machine manufacturers continually seek to develop new wagering games that are desirable to players. Relative to slot machines, gaming machine manufacturers frequently product machines having new themes. Those themes may relate to movies, televisions shows, characters or the like. The artwork and game symbols which are used in the game may be derived from or relate to the particular theme. These machines attract players who are fans of the movies, shows, characters or the like.

In the area of card games, most of the development has related to adding wagering features to or modifying the rules of existing games, but where the game is still played using one or more conventional decks of cards. For example, the game of blackjack is well known. However, this game has a relatively low payout. Thus, many side bets have been added to the game based upon combinations of the dealt cards, wherein the player may be paid a large jackpot for a winning side bet. Similar features have been developed relative to a wide variety of other traditional games which use conventional 52 card decks, such as variants of poker games, blackjack, baccarat and similar games.

One problem with creating new card game variants or entirely new card games relates to the use of one or more standard playing card decks in the use of the games. Only a certain number of variants of these games can be developed based upon the use of the same set of cards. At the same time, care must be exercised when deviating from the use of standard playing cards or other gaming equipment (such as standard dice, etc.), given that players are familiar with that equipment. A risk exists that if different gaming equipment is used that players may find it too hard to learn and play the game.

SUMMARY OF THE INVENTION

Embodiments of the invention comprise nonconventional playing cards, decks of nonconventional playing cards, and methods of playing and presenting games using nonconventional playing cards and gaming devices and systems for implementing such games.

One embodiment of the invention comprises a nonconventional deck of playing cards comprising a plurality of playing cards each having a card face bearing at least a primary indicium and a secondary indicium, the primary indicium comprising a card rank and a secondary indicium comprising a color, wherein cards of each card rank have the same secondary color indicium, wherein the number of cards having at least one lower card rank exceeds a number of cards having at least one higher rank.

In one embodiment, the nonconventional deck of playing cards may comprise at least one playing card of bearing each of five to seven ranks, and preferably six ranks. Such cards may comprise six cards bearing a first rank, seven cards bearing a second rank, eight cards bearing a third rank, 9 cards bearing a fourth rank, 10 cards bearing a fifth rank and 12 cards bearing a sixth rank.

In one embodiment, the cards of the first, third and fifth ranks bear a first secondary color indicium and the cards of the fourth and sixth ranks bear a second secondary color indicium. The color indicium may comprise a background color of at least a portion of the card.

In one embodiment, the ranks are designated by primary indicia comprising the characters of a Dragon, a Phoenix, a Tiger, a Panda, a Monkey and a Rabbit, having a rank from highest to lowest in that order.

In one embodiment, the nonconventional deck of playing cards includes at least one wild card.

In another embodiment, a nonconventional deck of playing cards comprises a plurality of playing cards each having a card face bearing at least a primary indicium and a secondary indicium, the primary indicium comprising a card rank, at least a first number of said plurality of playing cards having a first card rank and a second number of the plurality of playing cards having a second card rank, said first and second numbers of cards being different.

Additional embodiments of the invention comprise methods of playing and presenting games using the nonconventional playing cards or decks of playing cards.

One embodiment of a method of game play using a nonconventional deck of cards of the invention comprises providing a gaming table having a playing surface and a game layout; receiving player input of at least one ante wager; dealing a three card dealer hand and a three card player hand from the deck of nonconventional playing cards; receiving player input of at least one play wager; determining an outcome of the game with reference to the player hand and the dealer hand; and resolving the at least one ante wager and the at least one play wager.

In one embodiment of such a game the step of determining an outcome comprises determining if the player hand outranks the dealer hand, wherein the playing cards and the step of resolving comprises collecting the at least one ante wager and the at least one play wager if the player hand does not outrank the dealer hand and awarding winnings to the player if the player hand outranks the dealer hand.

In one embodiment, the game may include the option to place an Ante bonus wager which can only be won if the player's hand is winning and comprises a designated winning Ante bonus wager, and/or one or more side bets, where the side bets may be won whether or not the player's hand beats the dealer's hand, so long as the player's hand comprises a predetermined side bet winning hand.

In yet another embodiment of a game, a player places one or more proposition style bets and a single dealer or community hand (such as three cards from a nonconventional deck of cards of the invention) is dealt. The cards in that hand are evaluated against the designated winning outcomes for the bets, such as whether the hand comprises a Three of a Kind, cards of the same secondary indicium of color, etc.

In one embodiment of the invention, gaming devices or systems are uniquely configured to present a wagering card game to one or more, and preferably a plurality, of players. Such a device may comprise a unique gaming table. The table may display a gaming table layout which includes a dealer station and player positions, input receiving devices, such as for receiving or detecting the placement of wagers and player inputs such as wheel spin inputs, and one or more electronic video displays. Games of the invention may also be presented at uniquely configured gaming machines or via uniquely configured gaming systems.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise nonconventional playing cards, nonconventional decks of playing cards, and methods of playing and presenting games using such cards.

Exemplary nonconventional playing cards and a deck of nonconventional playing cards are illustrated in FIGS. 1-9. In one embodiment, each playing card has a front and a back. Each playing card may be rectangular in shape and have a size similar to conventional playing cards. However, the cards could have other shapes and sizes.

In a preferred embodiment, the front of the playing card displays at least one card indicium, and preferably multiple indicia. The back of the playing card preferably does not display card indicia. The back of the card might be blank or might bear ornamentation or the like.

In a preferred embodiment, each playing card is a physical playing card. Such a card might comprise a card stock, such as coated paper or the like. The playing card indicia may be printed upon the front of the card and the ornamentation may be printed on the back of the card. In other embodiments, the playing card might comprise a graphical representation of a card, such as displayed on an electronic video display based upon graphic or video data.

In one embodiment, the card indicia associated with one or more of the cards comprises a primary indicium which comprises a primary indicator, and a secondary indicium which comprises a secondary indicator. In one embodiment, the primary indicator comprises a card rank or value indicium. This indicium may comprise a card character. In one embodiment, the secondary indicator comprises a card color.

Figure 1:
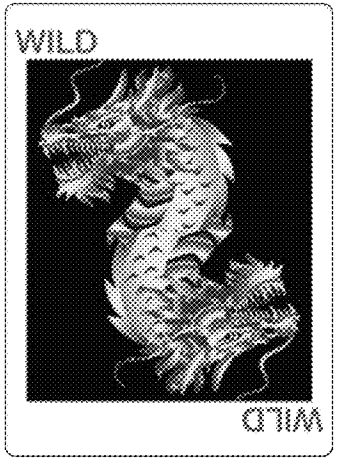
FIGS. 1-8 illustrate embodiments of nonconventional playing cards in accordance with the invention.

Embodiments of playing cards may comprise one or more of the following:

1) As illustrated in FIG. 1, a Wild playing card 220W, which bears on its card face a unique image of dragon (different from a Dragon card 220D) and/or the word "Wild".

Figure 2:
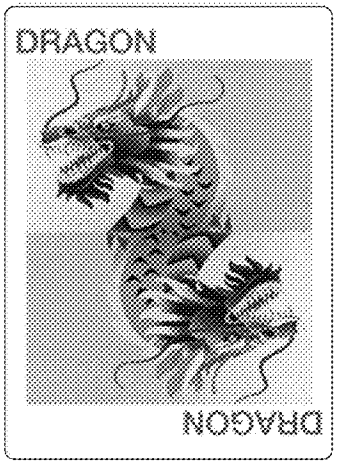
Figure 3:
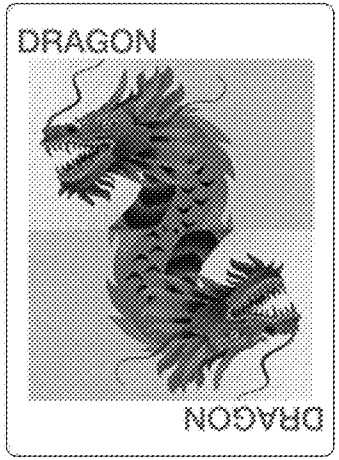
Figure 4:
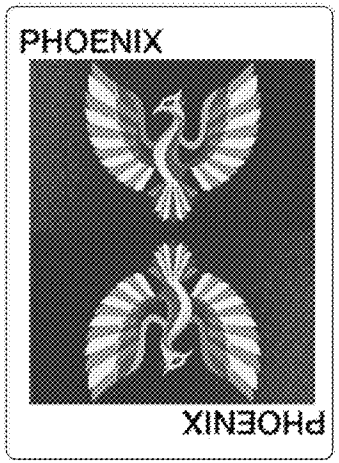
Figure 5:
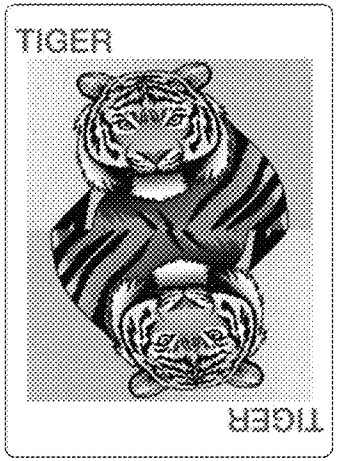
Figure 6:
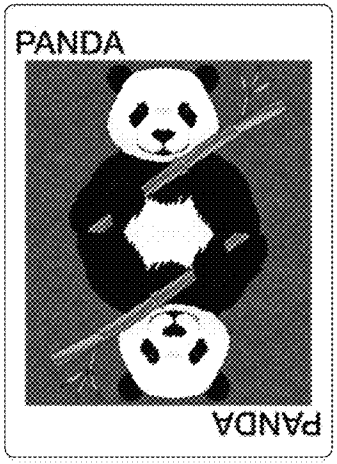
Figure 7:
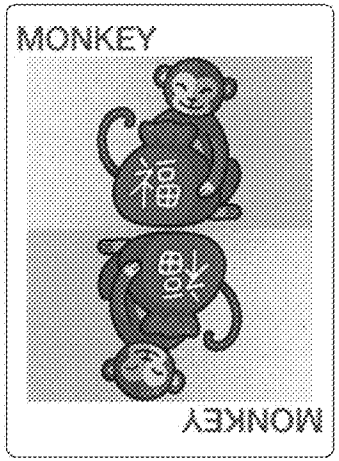
Figure 8:
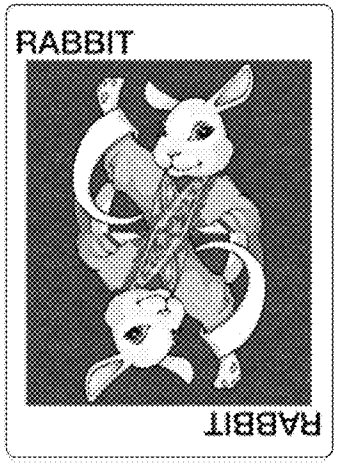

2) As illustrated in FIGS. 2 and 3, a Dragon playing card 220D, which bears on its card face an image of one or more dragons and/or the word "Dragon" (and wherein the cards may be distinguished by secondary indicium, such as the color of the Dragon);

3) As illustrated in FIG. 4, a Phoenix playing card 220X, which bears on its card face an image of one or more phoenix and/or the word "Phoenix";

4) As illustrated in FIG. 5, a Tiger playing card 220T, which bears on its card face an image of one or more tigers and/or the word "Tiger";

5) As illustrated in FIG. 6, a Panda playing card 220P, which bears on its card face an image of one or more pandas and/or the word "Panda";

6) As illustrated in FIG. 7, a Monkey playing card 220M, which bears on its card face an image of one or more monkeys and/or the word "Monkey"; and 7) As illustrated in FIG. 8, Rabbit playing card 220R, which bears on its card face an image of one or more rabbits and/or the word "Rabbit";

In one embodiment, as noted above, the cards preferably bear one or more secondary indicium, such as colors. For example, the primary indicium, such as the card characters, may be printed on a background comprising the secondary indicium comprising the color (wherein the background color may be printed on all or a portion of the card face). In one embodiment, the color attributes of the cards are associated with the characters of the cards and the color attributes of cards of one or more of different characters might be the same. For example, the card color of Rabbit cards 220R and Panda cards 220P may be red, the card color of Dragon cards 2220D and Tiger cards 220T may be yellow, the card color of the Wild card 220W may be black, and the card color of the Phoenix cards 20X may be blue.

Other embodiments of the invention comprise one or more decks of nonconventional playing cards. In one embodiment, such decks comprise combinations of at least two non-conventional playing cards of the present invention.

Figure 9:
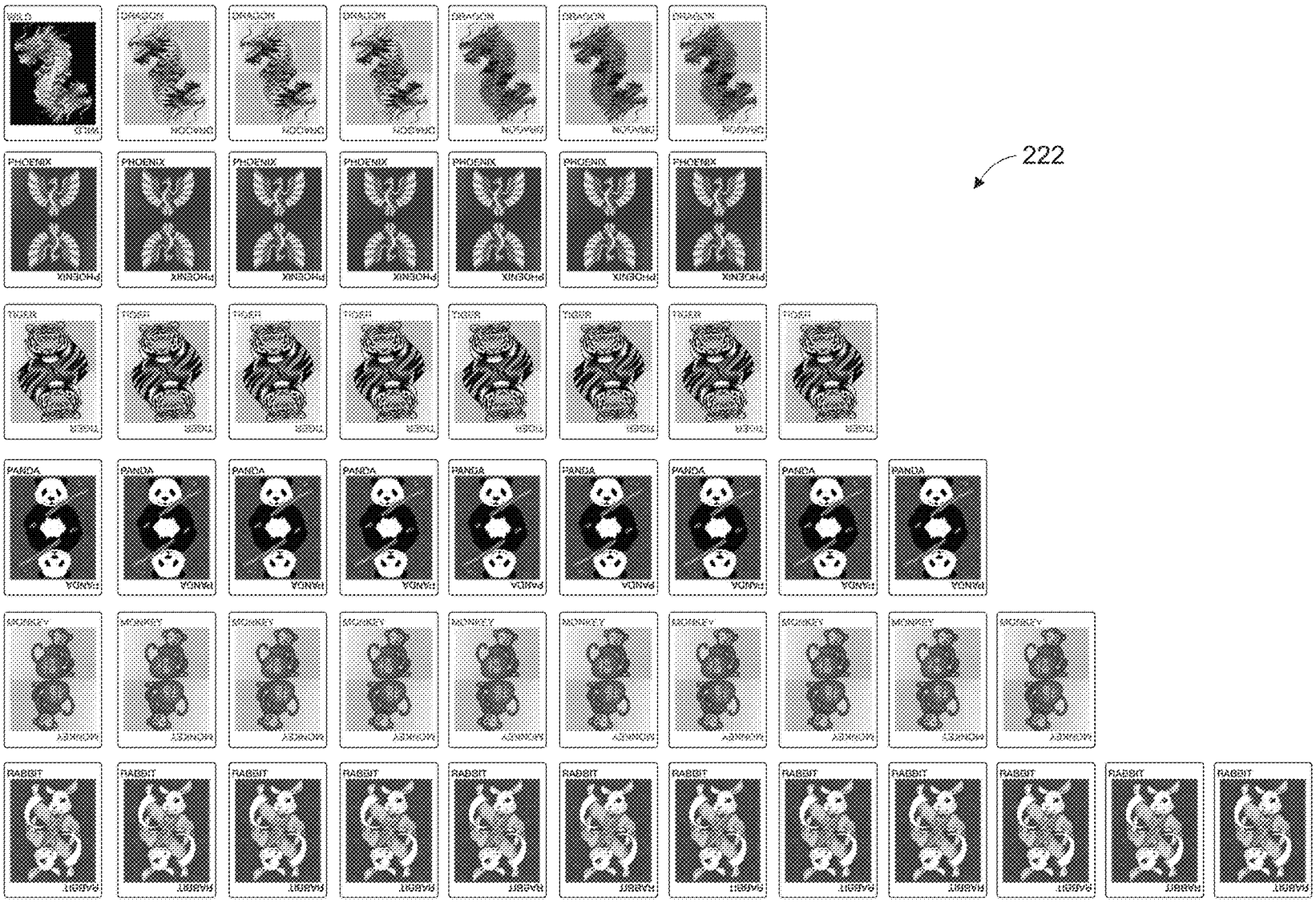
FIG. 9 illustrates one embodiment of a nonconventional deck of playing cards in accordance with the invention.

In one embodiment, as illustrated in FIG. 9, a nonconventional deck of playing cards 222 may comprise 53 cards comprising: 1) Six (6) Dragon cards 220D, 2) Seven (7) Phoenix cards 220X, 3) Eight (8) Tiger cards 220T; 4) Nine (9) Panda cards 220P, 5) Ten (10) Monkey cards 220M, 6) Twelve (12) Rabbit cards 220R, and 7) One (1) Wild card 220W.

In one embodiment, one or more of the playing cards might have a tertiary attribute or indicia. For example, the card characters might have different appearances or the like. For example, as noted above, the Dragon cards 220D may include blue or red dragon images, thereby providing a tertiary indicator between the different Dragon cards (as noted, the Wild card 220W may bear a dragon character, and may be distinguishable by being gold and having a different secondary indicium in the form of a black background color).

As noted above, the cards preferably have a rank. Relative to the deck of cards illustrated in FIG. 1, the ranking may comprise, from highest to lowest: Dragon, Phoenix, Tiger, Panda, Monkey and Rabbit. The Wild card 220W may be deemed to have the rank and/or color of any other card or might have other attributes. For example, the Wild card 220W might be capable of having the rank and/or color of any other card except a Dragon card, wherein if the Wild card 220W is used as a Dragon, then it is deemed to comprise a gold Dragon as illustrated in its face.

It will be appreciated that other nonconventional cards may be utilized and that a deck of nonconventional cards might vary from that above. For example, it is possible for the deck to not include a wild card or to include more than one wild card.

In the embodiment illustrated, a deck includes cards of six (6) ranks (plus the Wild card 220W). The deck might include cards of less than six (6) ranks, or more than six (6) ranks, such as five (5) or seven (7) ranks or the like. However, six (6) is preferred.

It is also noted that while FIG. 1-9 illustrate cards having preferred characters comprising the primary indicium of rank, other characters or elements might be provided or utilized (e.g. a shark, lobster, starfish, tuna, etc.). In addition, other secondary indicium might be utilized, such as other colors or entirely other indicia such as symbols.

Figure 10:
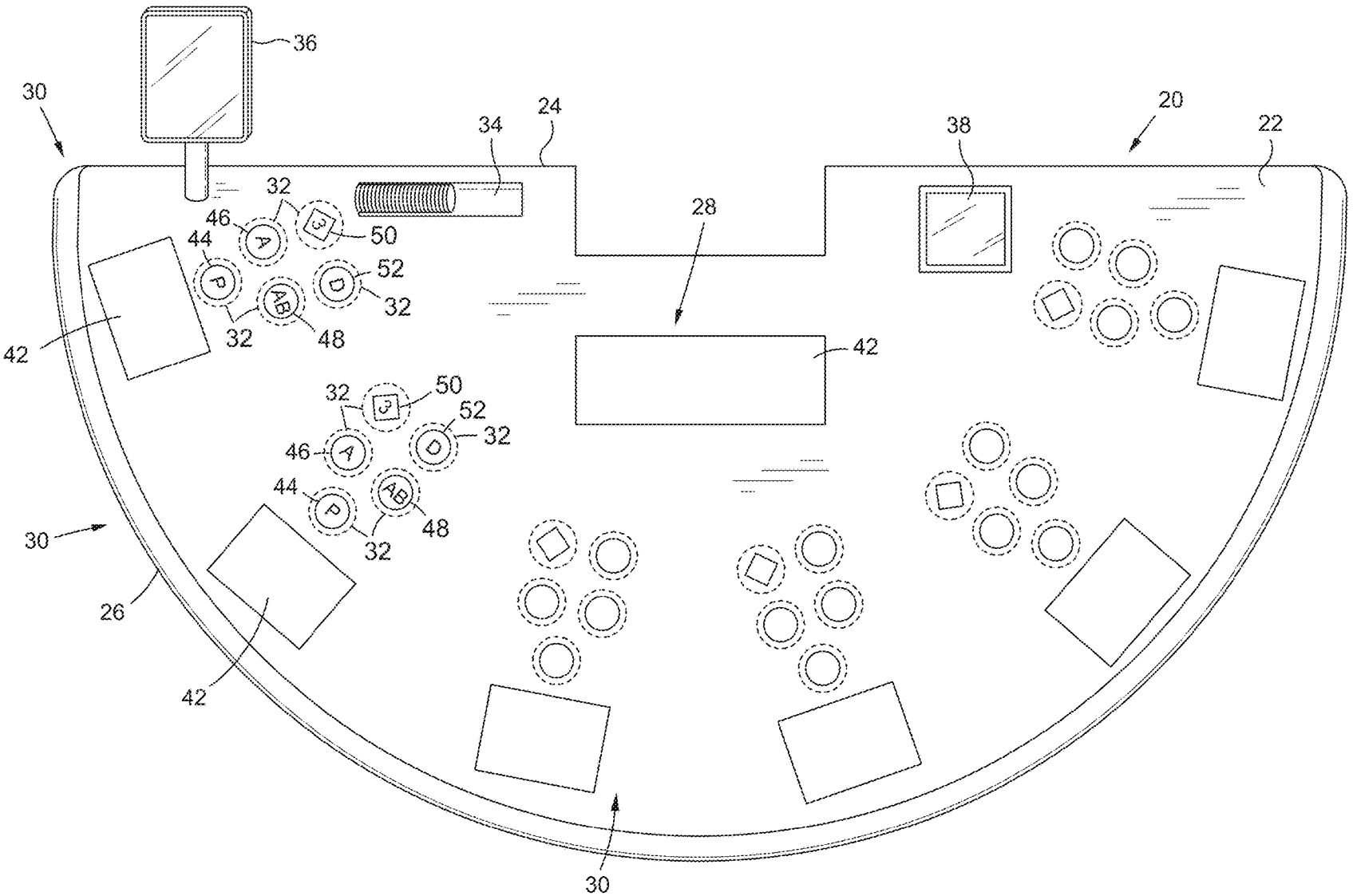
FIG. 10 illustrates one embodiment of a game table and associated game layout for playing and presenting a game of the invention.

Additional embodiments of the invention comprise methods of game play and presentation using the nonconventional cards of the present invention. Such a game may be played or presented relative to a gaming table. One embodiment of a gaming table in accordance with the invention will be described with reference to FIG. 10. As illustrated in FIG. 10, a game playing surface, such as a gaming table 20, is provided. The game table 20 defines a top or playing surface 22. The game table 20 may include one or more supports, such as a base, legs or the like (not shown) via which the playing surface 22 is elevated above a supporting surface such as a gaming floor.

The shape of the playing surface 22 may vary. In one embodiment, the game table 20 has a rear having a rear edge 24 which is generally straight and has an opposing front having a front edge 26 which is generally arcuate. A bumper or cushion may be located at either or both edges 24,26.

In one embodiment, the playing surface 22 is generally planar. However, the playing surface 22 could have one or more raised areas and/or one or more depressed areas or other features which are integrated into the table or added to the table, such as by being located on or mounted to the top surface thereof. Various game-related information or features are preferably associated with the game table 20. In one embodiment, the playing surface 22 comprises a gaming felt or similar element(s) which are located over a substrate, such as a planar support. The gaming felt may bear game play information or other information, such as by printing on the felt. This information may vary, such as depending upon the game or games which are to be implemented at the game table 20. For example, as indicated above, printing on the gaming felt may comprise one or more pay tables, card locations 42 (e.g. one or more designated areas at or into which one or more cards may be dealt) and the like.

In one embodiment, the configuration of the game table 20, such as via elements which are associated with the table 20 and information printed on the gaming felt, defines a dealer station 28 where a dealer may run a game, and one or more player positions 30. The dealer station 28 is generally located at the rear edge 24 and the player positions 30 are located opposite the dealer station 28 at the front or front edge 26. The dealer may, for example, stand at the rear of the table adjacent to the dealer station 28. A player may stand or sit adjacent to each player position 30 at the front of the game table 20.

In one embodiment, the game which is presented at the game table 20 comprises a wagering game. Wagers may be placed using physical gaming chips or other elements. In one embodiment, the game table 20 may define one or more wagering areas. For example, as described below relative to a game called Dragon Poker, the game table 20 may define an Ante wager area 46, an Ante Bonus wager area 48, a Play wager area 44, a 3 Card Bonus wager area 50 and a Dragon bonus area 50. These areas or locations may be defined on the game table 20 (such as by printing on a felt surface thereof and/or via raised or depressed areas or other physical features), such as in conjunction with each player position 30.

In another embodiment, wagers by players may be sensed by detecting the association of one or gaming chips (or monies or other wagering implements) with one or more input receiving devices or input sensors 32. The input receiving devices or input sensors 32 might comprise buttons (wired or wireless), or other input devices, but preferably comprise proximity sensors. The input receiving devices 32 may be located in or on the game table 20 and are configured to detect inputs, such as provided by players at the playing surface 22. In the case of proximity sensors, the sensors may be any type of proximity sensor now known or later developed, such as IR, acoustic, capacitive, or the like In one embodiment, one or more input receiving devices 32 are associated with each player position 30, thereby providing a means for each player to provide input relative to game play at the gaming table (and whereby the wagers of each player may be distinguished from those of the other players). For example, a different input receiving device 32 might be associated with each different wagering area, whereby wagers placed by a player relative to one or more different wagering areas may be independently detected.

In one embodiment, the dealer station 28 may include one or more chip trays 34 which are located on or at the game table 20 for storing chips which may be used to pay player winnings and/or in which chips which were used by players to place wagers may be collected.

In one embodiment, the game table 20 may include a number of other features. For example, the game table 20 may include one or more table displays 36. The table display 36 may comprise an electronic video display (such as an LCD, LED, OLED, DLP or other types of displays which are now known or later developed) or might even comprise a mechanical and/or electro-mechanical display device such as one or more spinning wheels or reels. The table display 36 may be located at or near the game table 20 for use in displaying game related information such as pay table information, game status information, game outcome information, bonus information or the like. The table display 36 might also be used to display promotional information or advertising. In one embodiment, the table display 36 displays the payouts for winning bet outcomes of the present invention.

The game table 20 might also comprise or include various input devices and/or other display devices. The input devices might include one or more dealer input devices such as one or more buttons or a dealer touchscreen display 38. For example, the dealer display 38 might comprise a display which displays game-related information to the dealer and allows the dealer to provide various inputs.

Of course, various other types of input and display devices might be associated with the game table 20. The game table 20 might also include player touch-screens, inputs buttons or the like.

Additional details of a gaming table in accordance with one embodiment of the invention will be described with reference to FIG. 11. As illustrated, in this embodiment, elements of the game table 20 are associated with or connected to at least one table controller 100. The table controller 100 may be located at the game table 20 or may be remote therefrom.

In one embodiment, the table controller 100 comprises at least one processor 102 which is configured to execute machine readable code fixed in a tangible medium (e.g. "software"). The table controller 100 may also comprise one or more information or data storage devices 104. These data storage devices 104 may comprise any type of data storage device such as ROM, RAM, EPROM or the like, as well as mass storage devices such as hard drives. The data storage devices 104 may store various data, including game code or software which is executable by the processor(s) 102 and other data, such as game data including wager data, game outcome data, images, etc.

The table controller 100 preferably includes one or more communication interfaces 106. The communication interface(s) 106 may facilitate wireless and/or wired communications with one or more remote systems or devices in accordance with various protocols (USB, Wi-Fi, Bluetooth, Ethernet, Firewire, etc.). In one embodiment, data or information may be exchanged between the processor(s) 102, data storage device(s) 104 and communication interface(s) 106 via one or more interfaces, such as a system bus 108. Of course, the table controller 100 might have other configurations, including other elements or features.

Figure 11:
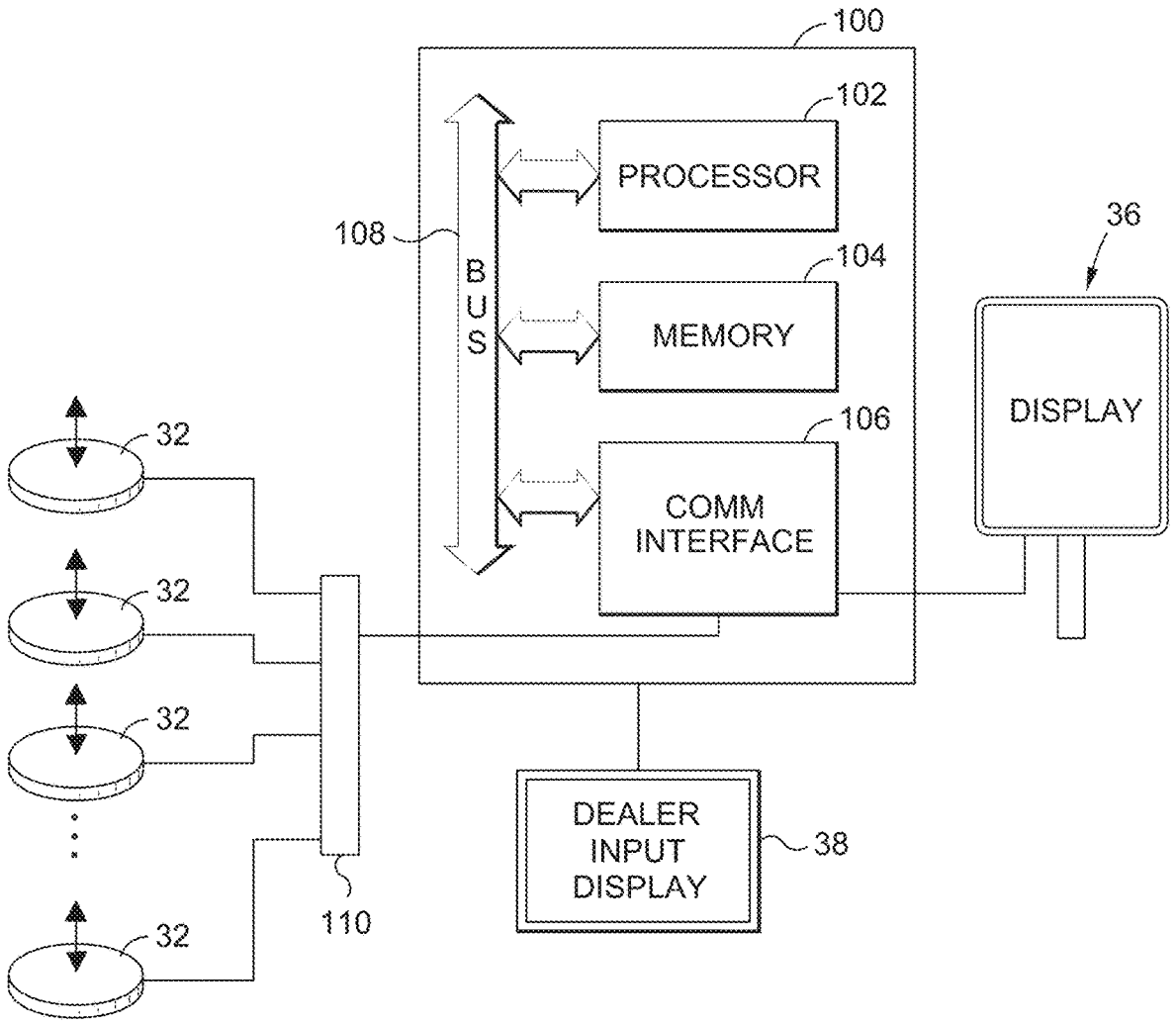
FIG. 11 illustrates one embodiment of a gaming system in accordance with the invention.

As illustrated in FIG. 11, the one or more input receiving devices 32 of the gaming table 20 may be interfaced with the table controller 100 to that the table controller 100 may receive information from those devices 32 and, in some embodiments, to transmit information to those devices. Likewise, the dealer input and/or display devices, such as the dealer touchscreen 38, may be interfaced to the table controller 100. Also, other input and/or display devices such as the table display 36 may be interfaced to the table controller 100.

In one embodiment, the table controller 100 or other devices associated with the game table 20 may determine player monetary or chip value balances, including based upon monies associated with the table by the player (such as chips purchased), amounts wagered and amounts won or the like.

The game table 20 of the invention may include or be associated with other elements or devices. For example, the game table 20 might include other gaming equipment, such as one or more player displays (such as located at each player position and configured to display game information, player tracking information, advertising or other information), card shoe(s), card reader(s), card shuffler(s), player tracking devices (such as for reading a player tracking card or other media of a player for use in tracking the player's game play) and the like. The game table 20 might also be connected to external devices. For example, the table controller 100 might be connected to one or more casino servers or systems, such as a casino accounting server which tracks game play at each game table 20, such as relative to the amounts of wagers placed and winnings paid to the players, among other information. The game table 20 might also be connected to a player tracking server and include player tracking elements such as player card readers.

The gaming system might include other elements, such as input receiving device controllers or the like. In one embodiment, the input receiving devices 32 communicate with a hub or aggregator 110 which communicates with the table controller 100. The hub 110 may be configured to read or determine the status of each input receiving device 32 and provide information to the table controller 100, such as when the status of an input receiving device 32 changes. The hub 110 may also comprise a power source for the input receiving devices 100. As another example, a proximity-type input sensor might be configured as a USB type device having a USB controller. The table controller 100 may be configured to control the proximity device as a USB device. In this regard, the processor 102 and/or one or more sub-processors or controllers may be utilized to control the input receiving devices.

In one embodiment of the invention, different input devices might be utilized for receiving different inputs (such as one input device for receiving a wager input and another input device for receiving a "spin" input or the like). In another embodiment, the one or more input receiving devices 32 are configured to receive multiple inputs. Each input receiving device 32 may be configured to receive two or more inputs. The inputs may be game-related inputs by a player and comprise two or more different types of inputs at two or more different times.

Figure 12:
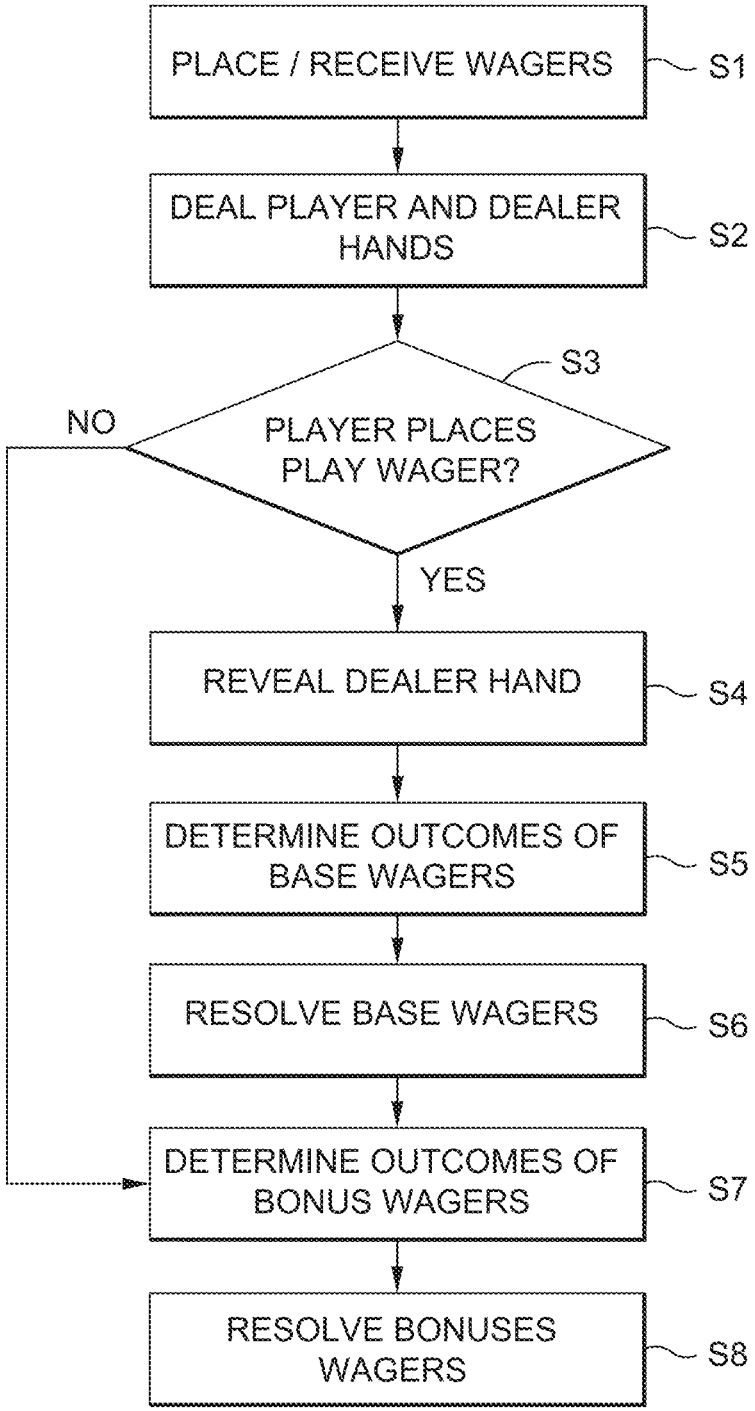
FIG. 12 is a flow chart which illustrates one method of playing and/or presenting a game in accordance with the invention.

Additional details of methods, devices and systems of the invention will now be described. FIG. 12 is a flow diagram which illustrates one method of presenting and playing a game in accordance with one embodiment of the invention. As detailed herein, the game might be played or presented at a gaming machine or device, at a gaming table or the like. In a preferred embodiment, the game is played at a gaming table by a dealer and at least one player, such as up to 7 players or more. This game may be referred to as "Dragon Poker."

Preferably, the game is presented as a wagering game in which a player is required to place at least one wager in order to play the game and where the player has the opportunity to be awarded winnings. Thus, in one embodiment, in a step S1, a player places at least one wager, such as an Ante wager. In one embodiment, the player may optionally also place, or be required to place, an Ante Bonus wager.

In one embodiment, a player places one or more chips, coins or the like at the wager location corresponding to the wager(s) they would like to place (such as the Ante wager location 46 and the Ante Bonus wager location 48 as illustrated in FIG. 10), such as by locating the one or more chips or the like in proximity to the one or more sensors for detection thereby. Each wager may be required to be of a certain minimum size and may also have a maximum size.

In a step S2, the game is initiated. In a preferred embodiment, the game is played using a deck of nonconventional cards, such as the deck of cards which is described above and which is illustrated in FIG. 9.

In a preferred embodiment, three cards are dealt from the deck to a player hand and three cards are dealt from the deck to a dealer hand. The cards may be dealt in a variety of manners. In the case of a gaming machine, the cards may be generated via random selection and displayed as video images. In the case of a table, the cards may be dealt (such as by the dealer) from a deck or set of physical playing cards, including from a shoe. Preferably, each of the cards which are dealt to the player hand are dealt or displayed face-up so that the card indicia on the cards is visible to the player and the dealer, while the cards which are dealt to the dealer hand are dealt face down.

Where multiple players are playing the game, a different player hand is preferably dealt to each player, such as to the player location corresponding to each player (but only a single dealer hand is dealt). The dealer hand may be dealt to the dealer hand area 42 of the dealer position 28 and the player hands may be dealt to the player hand areas 42 of the player positions 30.

In step S3, each player then determines, such as by an inspection of their hand, whether to fold (in which case the player loses their Ante wager and, if placed, their Ante Bonus wager) or place a Play wager. In one embodiment, the Play wager may comprise a wager of the same amount as the Ante wager.

In a step S4, the dealer hand is preferably revealed. This may comprise turning over the cards of the dealt dealer hand on the gaming table 20.

In a step S5, the outcomes of the base game wagers of all players who have not folded is determined. The base game wagers preferably comprise the Ante, Ante Bonus and Play wagers.

First, it is determined whether the player's hand must has a higher rank than the dealer's hand. This is determined based upon the rankings of the cards in the player's hand and the dealer's hand. For example, relative to the nonconventional deck of cards illustrated in FIG. 9, the ranking would be, from highest to lowest: 1) Trips or Three of a Kind: Three of the same cards in the hand, with Dragons being the highest ranking and other combinations of three of the same cards in the rank order described above; 2) Pair: Two of the three cards in the hand having the same rank, with a pair of Dragons again having the highest ranking and proceeding in order by card rank, wherein if the player's hand and the dealer's hand have the same pair, the rank of the third card in each hand will determine the higher hand and if the third cards are the same, the hand will be declared to be a push; 3) High card: none of the cards in the hand are of the same rank and so the rank of the hand is determined by the highest ranking individual card in the hand, wherein if the player's hand and dealer's hand have the same high card, the rank of the next card or cards will determine the higher hand, wherein if the ranks of all of the cards in the player's hand and the dealer's hand are the same, the hand will be declared to be a push.

If the player's hand is declared a push to the dealer's hand, then as noted below, the player's base game wagers are returned and no winnings are awarded for those wagers.

If the player's hand does not have a higher ranking than the dealer's hand, then the player preferably loses their Ante wager, any Ante Bonus wager and the Play wager.

If the player's hand does have a higher ranking than the dealer's hand, then the player preferably wins their Ante and Play wagers. The player's Ante Bonus wager is also then resolved, such as by determining whether the player's hand comprises at least one predetermined winning Ante Bonus hand, such as based upon a paytable such as that detailed below.

In a step S6, base wagers are resolved based upon the determined outcomes. In one embodiment, when the player wins their Ante and Play wagers those wagers are returned and they are paid winnings at 1:1 times their wager (e.g. if the player placed a $100 Ante wager and $100 Play wager and won, they would be paid winnings of $100 for their Ante wager and $100 for their Play wager).

A player may be paid winnings for a winning Ante Bonus wager if the player's hand comprises a predetermined hand. Otherwise, that wager is a push (e.g. that wager is merely returned). Set forth in Table 1 is one example of a paytable of hands and payouts for the Ante Bonus wager:

TABLE 1

| Outcome | Pay |
|---|---|
| Any Three Dragons | 20 to 1 |
| Three Phoenix | 7 to 1 |
| Any Other Trips | 4 to 1 |
| 2 Pandas or Better | 1 to 1 |
| Winning Hand | Push |

In one embodiment, the game may include one or more optional side or additional bets or wagers. In one embodiment, the player is required to place these wagers along with the Ante and optional Ante Bonus wagers (e.g. before any cards are dealt at step S1).

In one embodiment, one side bet comprises a 3 Card Bonus side wager or bet. This side bet is won if the player's hand meets any of the predetermined winning criteria for that wager. In one embodiment, the player may win the 3 Card Bonus wager whether they win or lose their base game wagers (e.g., the Ante and optional Ante Bonus wagers, and any Play wager, if placed). One embodiment of a pay table of winning 3 Card Bonus wagers and associated winnings is as follows in Table 2:

TABLE 2

| Outcome | Pay |
|---|---|
| Three Dragons | 40 to 1 |
| Three Phoenix | 30 to 1 |
| Three Tiger | 15 to 1 |
| Other Trips | 10 to 1 |
| Two Dragons | 4 to 1 |
| Two Phoenix | 2 to 1 |
| Two Tigers | 1 to 1 |

In one embodiment, one side bet comprises a Dragon Bonus side wager or bet. This side bet is won if the player's hand meets any of the predetermined winning criteria for that wager. In one embodiment, the player may win the Dragon Bonus side wager whether they win or lose their base game wagers (e.g. their Ante and optional Ante Bonus wagers, and any Play wager, if placed). One embodiment of a pay table of winning Dragon Bonus wagers and associated winnings is as follows in Table 3:

TABLE 3

| Outcome | Pay |
|---|---|
| Three Red Dragons | 1000 to 1 |
| Three Blue Dragons | 1000 to 1 |
| Three Dragons With Gold Dragon | 200 to 1 |
| Three Dragons | 60 to 1 |
| Two Dragons | 7 to 1 |
| Gold Dragon | 5 to 1 |

As noted above, the amount of one or more of the wagers might have a minimum value or maximum value, or might be limited to particular amounts. For example, the Dragon bonus wager might be limited to either a $2 wager or a $5 wager (wherein the winning awards for those wagers would comprise 2 times or 5 times the amounts designated in Table 3).

In one embodiment, a player may be permitted to place either or both the 3 Card Bonus side bet and Dragon Bonus side bet. Preferably, as illustrated in FIG. 12, after the resolution of the base game wagers in step S6, and relative to any player that folded in step S3, the outcomes of the bonus wagers are determined in step S7. Then in step S8, the bonus wager are resolved based upon those outcomes (such as by collecting the bonus wagers which were losing or paying winnings for winning bonus wagers, such as based upon the pay tables set forth above).

Figure 13:
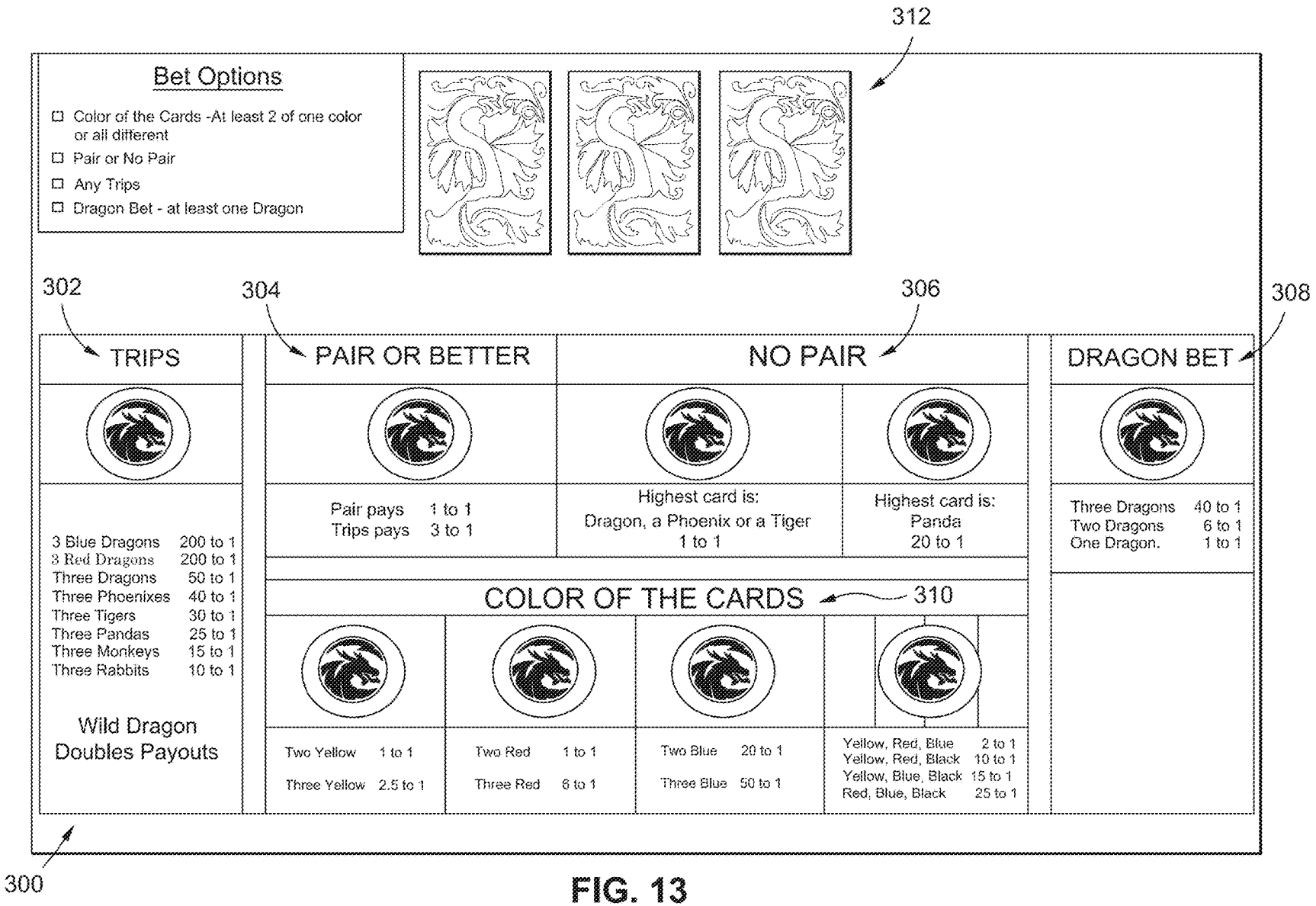
FIG. 13 illustrates another embodiment of a game layout for playing and presenting a game of the invention.

Another embodiment of a game which may be presented and played with the nonconventional cards of the present invention will be described with reference to FIG. 13. This game may be referred to as Dragon Treasure. This game may be played by a single player or multiple players. FIG. 13 illustrates a player position or area 300, such as might be displayed on a display of a gaming machine or displayed at a gaming table, such as the gaming table illustrated in FIG. 10.

In accordance with this game, in a step S1 the player places one or more wagers. In accordance with this embodiment of the invention, the player might be permitted to make one or more of the following wagers:

1. A "Trips" bet 302, such as comprising that the three dealt cards will comprise 3 Blue Dragon cards, 3 Red Dragon cards, any 3 Dragon cards, 3 Phoenix cards, 3 Tiger cards, 3 Panda cards, 3 Monkey cards or 3 Rabbit cards, wherein if any one of those sets of three cards is dealt, the outcome of the wager is winning.

2. A "Pair or Better" bet 304, such as comprising that the three dealt cards will comprise at least two cards of the same rank, wherein if the dealt cards comprise three cards of the same rank, higher winnings may be awarded.

3. A "No Pair" bet 306, such as comprising that the three dealt cards will not comprise at least a pair of cards of the same rank, such as either a wager that the three cards comprises only a high card hand of a Dragon card, a Phoenix card or a Tiger card, or that the high card is a Panda card.

4. A "Dragon" bet 308, such as comprising that the three dealt cards will comprise at least one Dragon card, wherein the amount of winnings paid for a winning bet may vary depending upon how many Dragon cards are in the hand.

5. A "Color" bet 310, such as comprising that of the three dealt cards, at least two or three of the cards will have the same secondary indicium of color, such as two or three yellow cards, two or three red cards, two or three blue cards, or one card each of: a) yellow/red/blue, b) yellow/red/black, c) yellow/blue/black, or d) red/blue/black.

After all bets have been placed, in a step S2 a single hand of three cards 312 is dealt. In one embodiment, this hand may be referred to as a community hand or a dealer hand. The hand is preferably dealt face-up.

The outcome of each of the player's wagers is then determined, as in a step S3. The wagers are then resolved based upon the determined outcomes, such as in a step S4. If the outcome of a particular wager is losing, the wager is preferably collected from the player and if the outcome is winning, then winnings are preferably paid, such as in accordance with the pay tables indicated in FIG. 13.

Of course, variations of the invention are contemplated. For example, the above-described steps might not be performed in the same order.

As noted above, in an embodiment where the deck of nonconventional cards includes at least one Wild card 220W, the Wild card 220W may be designated to have attributes other than the attributes identified on its face. For example, the Wild card 220W might be used with one or more other cards of the three dealt cards to form a winning combination by, for example, the Wild card 220W taking on the attributes of any other rank or color. Also, in some instances, the appearance of and use of the Wild card 220W to form a winning combination may increase the winnings for a particular winning outcome.

It will be appreciated that other winning outcomes and associated winning amounts may be defined other than those described and illustrated herein. In one embodiment, winning wagers might be paid as fixed value jackpots or progressive jackpots. For example, winning side bets might be paid as progressive jackpots. Such progressive jackpots might grow over time (until won, at which point they preferably reset back to a starting value), such as based upon the number of games played, time, based upon a portion of the side bets wagered, etc. For example, 95% of the side bets may, on average, be returned to the players by setting the jackpot values (and/or progressive growth values) in combination with the odds of winning the side bets.

As one example, winnings might be awarded in manners other than via pay table. For example, the player may be awarded side bet winnings based upon an award selection event such as a spin of an award wheel. For example, referring to FIG. 10, in one embodiment an award wheel may be displayed graphically on the display 36 at the game table 20. Each player who receiving a winning side bet outcome is given the opportunity to spin the wheel. As indicated above, in one embodiment, an input receiving device 32 may be activated. The player may then wave their hand or provide input to the input receiving device 32. The table controller 100 may then cause the display 36 to display a graphical representation of a spinning wheel which stops at a selected segment which corresponds to define the outcome of the wheel spin, and thus indicate the award which is awarded to the player. In such a configuration, the wheel spaces may display various awards, where those awards might vary depending upon the particular winning side bet outcome which the player received.

In one embodiment, the virtual wheel may be configured with segments which have associated awards and the probability of a particular segment being selected may be weighted. In the wheel spin event, a random number generator or the like may be used to generate a random number which is then compared to a lookup table of outcomes. The selected outcome corresponds to a segment having an assigned award. The controller may then cause the display 36 to display a wheel spin in which the wheel stops at the selected segment. In this configuration, certain outcomes or awards are more likely to occur than others Of course, the wheel spin event could be implemented by spinning a physical spinning wheel, such as where the stopping position of the wheel relative to a pointer or other selector is controlled, such as via a motor. The award selection event might also be represented by other than a wheel spin, but by other events.

Winnings (for winning game wagers or side bet wagers) might be paid in the form of chips, electronic credits or the like. The player might cash-out electronic credits to a printed ticket or the like, such as printed and issued by a printer at a gaming table or device. The player might then take that ticket to a cashier station or window for redemption, such as conversion to monetary funds. Likewise, a player might cash out chips in a similar manner.

In one embodiment, another embodiment, the above-reference paytables might be displayed to players using the table display 36. The displayed information might include, for example, current award values (which amounts may change over time and thus be updated over time, such as where the jackpots are progressive). In one embodiment, as noted above, the dealer might use a dealer control, such as the touch screen 38, to activate the base game wagering areas 44,46,48 and side bet areas 50,52 at the start of the game, so as to receive the bets from the players. If a player obtains a side bet winning outcome, the player might provide an input to the dealer control, such as the touch screen 38, such as to a particular displayed player seat location. The dealer might also provide an input of the particular bonus bet winning outcome, such as from a list of possible winning outcomes, as to each winning player. The dealer might then select a "pending award" button and then a "pay award" button in order to effectuate payment of the award to the winning player (which process may be repeated as to each player who obtains a side bet winning outcome). In one embodiment, the players may be paid electronic credit as their award, while in other embodiments, as noted above, a player might be awarded chips.

As indicated, the game of the invention may be implemented in various manners, such as via various gaming machines, devices and/or systems. For example, the methods of game play and presentation may also be implemented via a gaming machine or device. Such a gaming machine may have various configurations.

The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 14:
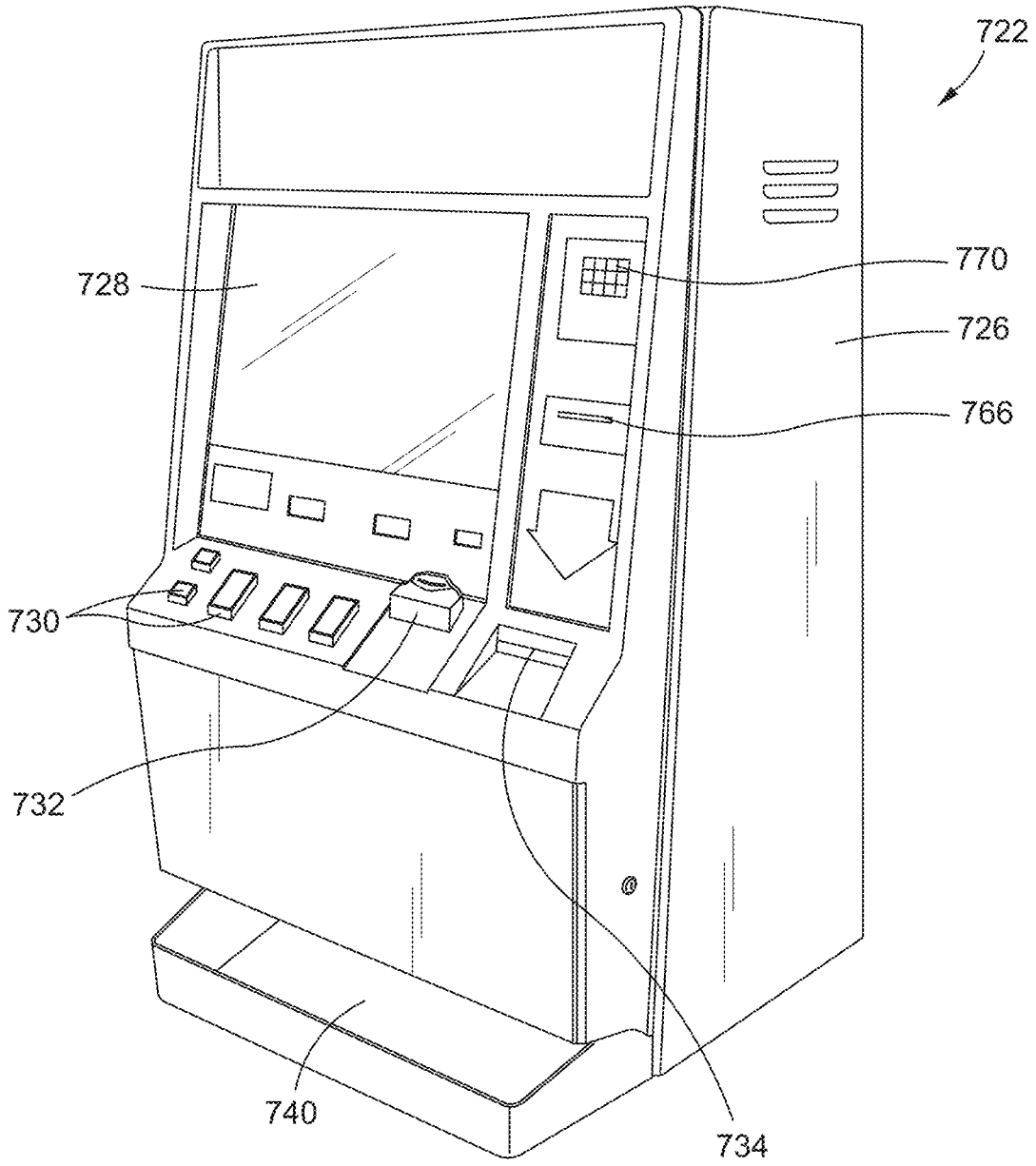
FIG. 14 illustrates one embodiment of a gaming machine for presenting a game in accordance with the invention.

One configuration of a gaming machine 722 is illustrated in FIG. 14. As illustrated, the gaming machine 722 generally comprises a housing or cabinet 726 for supporting and/or enclosing various components required for operation of the gaming machine. In the embodiment illustrated, the housing 726 includes a door located at a front thereof, the door capable of being moved between an open position which allows access to the interior, and a closed position in which access to the interior is generally prevented. The configuration of the gaming machine 722 may vary. In the embodiment illustrated, the gaming machine 722 has an "upright" configuration. However, the gaming machine 722 could have other configurations, shapes or dimensions (such as being of a "slant"-type, "bar-top" or other configuration as is well known to those of skill in the art).

The gaming machine 722 preferably includes at least one first display device 728 configured to display game information. The display device 728 may comprise an electronic video display such as a cathode ray tube (CRT), high resolution flat panel liquid crystal display (LCD), projection LCD, plasma display, field emission display, digital micromirror display (DMD), digital light processing display (DLP), LCD touchscreen, a light emitting display (LED) or other suitable displays now known or later developed, in a variety of resolutions, sizes and formats (e.g. 4:3, widescreen or the like). As one example, the display might comprise a 19" monitor from iBase (www.ibase.com.tw; Taipei, Taiwan, R.O.C.). The display device 728 may be capable of projecting or displaying a wide variety of information, including images, symbols and other indicia or information associated with game play, game promotion or other events. The gaming machine 722 might include more than one display device, such as a main or first display device 28 and a secondary display device. The two or more display devices might be associated with the housing or the gaming machine 722 might also include a top box or other portion which includes the one or more second display devices. Also, the gaming machine 722 might include side displays (such as mounted to the exterior of the housing 726) and might include multiple displays of differing sizes.

The gaming machine 722 is preferably configured to present one or more games upon a player making a monetary payment or wager. In this regard, as described in more detail below, the gaming machine 722 includes mechanism or means for accepting monetary value.

In one embodiment, as noted above, certain base game outcomes and side bet outcomes (but preferably not all outcomes) may be designated as winning outcomes (the non-winning outcomes may be referred to as losing outcomes) and awards may be provided for winning outcomes, such as monetary payments (or representations thereof, such as prize of credits) as detailed herein. As detailed below, the gaming machine 722 preferably includes a mechanism or means for returning unused monetary funds and/or dispensing winnings to a player.

The gaming machine 722 preferably includes one or more player input devices 730 (such as input buttons, plunger mechanisms, a touch-screen display, joystick, touch-pad or the like). These one or more devices 730 may be utilized by the player to facilitate game play, such as by providing input or instruction to the gaming machine 722. For example, such input devices 730 may be utilized by a player to place a wager, cause the gaming machine 22 to initiate a game, to "cash out" of the gaming machine, or to provide various other inputs.

In one preferred embodiment, the gaming machine 722 includes at least one microprocessor or controller for controlling the gaming machine, including receiving player input and sending output signals for controlling the various components or peripheral devices of the machine 722 (such as generating game information for display by the display devices). One example of a controller 134 is a Kontron KTQ87/mITX embedded Mini-ITX Motherboard with Intel Z87 Chipset and $4^{th}$ Generation Intel 17/5/13 Dual and Quad Core CPUs (www.kontron.com; Augsburg, Germany). The controller may be arranged to receive information regarding funds provided by a player to the gaming machine 722, receive input such as a purchase/bet signal when a purchase/bet button is depressed, and receive other inputs from a player. The controller may be arranged to generate information regarding a game, such as generating game information for display by the at least one display device (such as information comprising nonconventional playing cards which are dealt, as described above), for determining winning or losing game outcomes and for displaying information regarding awards for winning game wagers and side bets, among other things.

The controller may be configured to execute machine readable code or "software" or otherwise process information, such as obtained from a remote server. Software or other instructions may be stored at a memory or data storage device, e.g. in a fixed or non-transitory configuration. The memory may also store other information or data, such as data stored in table or other forms (including, but not limited to look-up tables, pay tables and other information including tracked game play information). The gaming machine 722 may also include one or more random number generators for generating random numbers (such as implemented by a random number generator software module stored in the memory and executable by the processor), such as for use in selecting the nonconventional playing cards and for presenting the game in a random fashion (e.g. whereby the game is presented in a manner in which the player cannot control the outcome) or pseudo-random fashion (e.g. such as where the game includes a skill component which can affect the outcome of the game). One embodiment of a random RNG engine, RNGCryptoServiceProvider Class, by Microsoft, is set forth below in Table 4.

TABLE 4

```
Language: c# .net
Code snippet:
        //
        // Summary:
        //   Fills an array of bytes with a cryptographically strong sequence of random
values.
        //
        // Parameters:
        // data:
        //   The array to fill with a cryptographically strong sequence of random
values.
        //
        // Exceptions:
        // T:System.Security.Cryptography.CryptographicException:
        //   The cryptographic service provider (CSP) cannot be acquired.
        //
        // T:System.ArgumentNullException:
        //   data is null.
static RNGCryptoServiceProvider __crypto = new RNGCryptoServiceProvider( );
var bytes = new byte[1];
__crypto.GetBytes(bytes);
```

Preferably, the controller is configured to execute machine readable code or instructions (e.g. software) which are configured to implement the game. In this regard, the gaming machine 722 is specially configured to present the game of the invention via specific software and/or hardware which causes the gaming machine to operate uniquely. For example, the controller of the gaming machine 722 may be configured to detect a wager, such as a signal from a player's depressing of an "Ante bet" button. Upon such an event and/or the player otherwise signaling the gaming machine to present the game, the controller may be configured to cause the at least one display 728 to display unique information, such as a unique graphical interface or unique game display, including images of the nonconventional playing cards (and player and/or dealer hands) or other game information. The controller may accept input from a player of game inputs via the one or more player input devices of the gaming machine 722. As indicated above, the machine readable code may be configured in various manners, such as by having various "modules" of software which are designed to implement specific features of the game play or game presentation.

The gaming machine 722 may be configured to generate and present games in a stand-alone manner or it may be in communication with one or more external devices or systems at one or more times. The gaming machine 722 might communicate with one or more of such external devices or systems via one or more communication ports or other interface devices. These ports or interface devices may be configured to implement various communication protocols (including proprietary protocols) and communicate via wireless, wired or other communication link. For example, the gaming machine 722 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 722 is configured to present one or more wagering games. The gaming machines 722 is preferably configured to accept value, such as in the form of coins, tokens, paper currency or other elements or devices representing value such as monetary funds. Thus, as indicated above, the gaming machine 722 preferably includes a mechanism or means for accepting monetary value. For example, the gaming machine 722 might include a coin acceptor 732 for accepting coins. Of course, associated coin reading/verifying devices and coin storage devices may be associated with the gaming machine 722 if it is configured to accept coins. Likewise, the gaming machine 722 might include a media reader 734. Such a reader may be configured to accept and read/verify paper currency and/or other media such as tickets. Of course, in such event the gaming machine 722 may further be configured with one or more paper currency or ticket storage devices, such as cash boxes, and other paper currency or media handling devices (including transport devices).

The gaming machine 722 might also be configured to read FOBs, magnetic stripe cards or other media having data associated therewith and via which value or funds may be associated with the gaming machine 722. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications, such as to enable the transfer of funds from the player to the gaming machine or system.

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). Such wager input options may allow the player to wager on the base game and optionally place the side bet in accordance with the present invention. In one embodiment, when the player's wager is received, the player's credit balance is reduced by the number of wagered credits. The player might then provide a separate input to begin the game. In other embodiment, the player might select a "play game" input, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 722 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 722 to indicate their desire to cash out, such as by selecting a "cash out" button or touch screen feature or providing other input. In response, a monetary value represented by the player's credit balance or the like is preferably paid, transferred or otherwise provided to the player. For example, upon an award or at cash-out, associated funds may be paid to the player by the gaming machine 722 dispensing coins to a coin tray 740. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In this regard, the gaming machine 722 may include one or more media printers or writers 48. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 722 may also include a player tracking device, such as a card reader 766 and/or an associated keypad 770 or other input device (such as a touch screen display). Such player tracking devices are well known and may permit the game operator to track play of players of the gaming machine. The tracked play may be utilized to offer player bonuses or awards.

The main game controller or processor may communicate with several of the peripheral devices via one or more intermediary controllers. For example, some of the peripheral devices might comprise USB type or enabled devices which are controlled by an intermediary USB controller.

A casino may have numerous such gaming machines 722, such as located on a casino floor or in other locations. Of course, such gaming machines 722 might be used in other environments, such as an airport, a bar or tavern or other locations.

It will be appreciated that the gaming machine illustrated in FIG. 14 is only exemplary of one embodiment of a gaming machine. For example, it is possible to for the gaming machine to have various other configurations, including different shapes and styles and having different components than as just described.

For example, instead of comprising a "casino"-style gaming machine, it is possible for the game of the invention to be presented on a computing device, including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays.

The gaming machine 722 may, as noted above, be part of a system which includes other devices. For example, the gaming machine 722 may communicate with one or more casino systems, such as a player tracking server or system, an accounting system or server, a ticketing system, a bonusing system, a tournament system, other gaming machines, and external devices.

Such a gaming machine 722 might be used, for example, to present the above-referenced game to one or more players in a configuration where the dealer is essentially automated.

The invention has numerous advantages. First, nonconventional cards and nonconventional decks of cards are provided. These decks of cards permit games to be played which have different features, odds, and the like, from traditional games which use conventional playing cards and conventional decks of such cards.

In one embodiment, a nonconventional deck of cards has a nonstandard number of ranks, such as five to seven ranks, and preferably six ranks (as compared to 13 ranks for a standard deck of playing cards). In addition, the number of cards of each of the ranks preferably varies, such as by providing a greater number of cards of lower ranks than higher ranks (wherein in a standard deck of cards there are 4 cards of each and every rank). In addition, the cards have secondary indicia, such as colors, wherein in a preferred embodiment, cards of the same rank all have the same secondary indicia (whereas in a standard deck of cards, cards of the same rank are all of different secondary indicia, such as different suits).

As one aspect of the invention, use of such a nonconventional deck of cards results in various advantages, such as allowing the creation of entirely new games based upon entirely new card combinations and/or games in which the probabilities of receiving certain combinations are altered. For example, in a game utilizing a single deck of standard cards, the odds for receiving the highest ranking card (usually an Ace) is 4/52, which is the same as odds for receiving the lowest ranking card (usually a Two; also 4/52). In accordance with a deck of the invention, the odds of receiving cards of at least one higher rank is lower than the odds of receiving cards of at least one lower rank. For example, as to the nonconventional card deck 222 illustrated in FIG. 9, the odds of receiving a Dragon card 220D is 6/53, whereas the odds of receiving the lowest ranked Rabbit card 220R is much higher at 12/53. In one preferred embodiment, the number of cards in the ranks decreases from the lowest up to the highest rank.

The nonconventional deck of the preferred embodiment of the invention also introduces the use of characters (such as Dragons, Rabbits, etc.) as primary indicium of rank, thus making the cards more interesting and unique than cards of standard decks.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A nonconventional deck of playing cards comprising:

a plurality of playing cards each having a card face bearing at least a primary indicium and a secondary indicium, said primary indicium comprising a card rank and a secondary indicium comprising a color, wherein cards of each card rank have the same secondary color indicium, wherein the number of cards having at least one lower card rank exceeds a number of cards having at least one higher rank.

2. The nonconventional deck of playing cards of claim 1 wherein said plurality of playing cards comprises at least one playing card of bearing each of six ranks.

3. The nonconventional deck of playing cards of claim 2 wherein said plurality of playing cards comprises six cards bearing a first rank, seven cards bearing a second rank, eight cards bearing a third rank, 9 cards bearing a fourth rank, 10 cards bearing a fifth rank and 12 cards bearing a sixth rank.

4. The nonconventional deck of playing cards of claim 3 wherein said cards of said first, third and fifth ranks bear a first secondary color indicium and said cards of said fourth and sixth ranks bear a second secondary color indicium.

5. The nonconventional deck of playing cards of claim 3 wherein one or more of said ranks comprise a Dragon, a Phoenix, a Tiger, a Panda, a Monkey and a Rabbit.

6. The nonconventional deck of playing cards of claim 3 further including at least one wild card.

7. The nonconventional deck of playing cards of claim 3 wherein a hierarchy of said ranks from highest to lowest comprises said first rank, said second rank, said third rank, said fourth rank, said fifth rank and said sixth rank.

8. The nonconventional deck of playing cards of claim 4 wherein said first and second secondary color indicium comprise a background portion of each of said cards.

9. A nonconventional deck of playing cards comprising:

a plurality of playing cards each having a card face bearing at least a primary indicium and a secondary indicium, said primary indicium comprising a card rank, at least a first number of said plurality of playing cards having a first card rank and a second number of said plurality of playing cards having a second card rank, said first and second numbers of cards being different.

10. The nonconventional deck of playing cards of claim 9 wherein said secondary indicium comprises an assigned card color.

11. The nonconventional deck of playing cards of claim 9 wherein said primary indicium of card rank comprise depictions of characters.

12. The nonconventional deck of playing cards of claim 11 wherein said characters comprise one or more of a Dragon, a Phoenix, a Tiger, a Panda, a Monkey and a Rabbit.

13. The nonconventional deck of playing cards of claim 9 wherein said deck comprises 53 cards comprising 52 playing cards bearing at least said primary indicium and a secondary indicium, plus a wild card.

14. The nonconventional deck of playing cards of claim 9 comprising at least five and no greater than seven ranks.

* * * * *